US007008289B2

(12) United States Patent
Norman

(10) Patent No.: US 7,008,289 B2
(45) Date of Patent: Mar. 7, 2006

(54) TOY WITH OPENABLE CONTAINER FROM WHICH ONE OR MORE OBJECTS SPRING OUT

(75) Inventor: Casey Norman, London (GB)

(73) Assignee: Genie Toys PLC, (GB)

( * ) Notice: Subject to any disclaimer, the term of this patent is extended or adjusted under 35 U.S.C. 154(b) by 0 days.

(21) Appl. No.: 10/832,628

(22) Filed: Apr. 27, 2004

(65) Prior Publication Data

US 2005/0075041 A1 Apr. 7, 2005

Related U.S. Application Data

(60) Division of application No. 10/414,970, filed on Apr. 16, 2003, now abandoned, which is a continuation of application No. PCT/GB01/04349, filed on Sep. 28, 2001.

(30) Foreign Application Priority Data

Oct. 16, 2000 (GB) ..... 0025337

(51) Int. Cl.
*A63H 13/16* (2006.01)

(52) U.S. Cl. ..... 446/310; 446/308

(58) Field of Classification Search ..... 446/308, 446/309, 310, 311, 312
See application file for complete search history.

(56) References Cited

U.S. PATENT DOCUMENTS 294,575 A 3/1884 Britton
2,303,652 A 12/1942 McGaugh et al.
2,858,644 A * 11/1958 Derham ..... 446/310
3,538,620 A * 11/1970 Kohner et al. ..... 434/258
3,763,591 A * 10/1973 Fontana ..... 446/202
3,798,806 A * 3/1974 Sanford ..... 40/124.03
4,165,579 A 8/1979 Chase
4,259,805 A 4/1981 Hornsby, Jr.
4,407,504 A 10/1983 Popov
4,453,340 A * 6/1984 Kozuka et al. ..... 446/437
4,662,633 A * 5/1987 Zaruba et al. ..... 273/459
4,774,780 A * 10/1988 Crowell ..... 40/124.08
4,881,915 A 11/1989 Liaw
4,903,958 A * 2/1990 DiCarlo et al. ..... 472/54
5,013,278 A 5/1991 Dixon et al.
5,055,084 A * 10/1991 Jokic ..... 446/486
5,108,337 A * 4/1992 Sloan et al. ..... 446/220
5,120,263 A 6/1992 Ierfino et al.
5,224,894 A * 7/1993 Nelson et al. ..... 446/73
5,293,707 A * 3/1994 Shaeffer ..... 40/412
5,304,096 A * 4/1994 Wilk ..... 472/137
5,579,813 A * 12/1996 Watts ..... 141/317
5,624,320 A * 4/1997 Martinez ..... 472/51
5,682,999 A * 11/1997 Larson ..... 206/768
5,687,992 A * 11/1997 Finkelshteyn ..... 283/117
5,897,418 A 4/1999 Spector (Continued)

FOREIGN PATENT DOCUMENTS

WO WO 93/03807 3/1993

*Primary Examiner*—Boyer D. Ashley
*Assistant Examiner*—Ali Abdelwahed
(74) *Attorney, Agent, or Firm*—DLA Piper Rudnick Gray Cary US LLP

(57) ABSTRACT

A toy including an openable container, and a non-porous, molded, hollow, elastic three-dimensional representative object arranged to be contained in a compressed condition within the container such that on opening the container the object springs out by assuming its uncompressed shape and size.

24 Claims, 9 Drawing Sheets

U.S. PATENT DOCUMENTS 5,954,563 A * 9/1999 Spriggs ..... 446/475
5,961,363 A 10/1999 Spector
6,001,019 A * 12/1999 Al-Bannai ..... 472/54
6,104,306 A * 8/2000 Hogue et al. ..... 340/686.1
6,203,017 B1 * 3/2001 Schultz ..... 273/285
6,494,759 B1 * 12/2002 Polick ..... 446/148
6,575,807 B1 * 6/2003 Spector ..... 446/320
6,592,426 B1 * 7/2003 Mesch ..... 446/310

* cited by examiner

TOY WITH OPENABLE CONTAINER FROM WHICH ONE OR MORE OBJECTS SPRING OUT

RELATED APPLICATIONS

This application is a divisional of application Ser. No. 10/414,970, filed Apr. 16, 2003, now abandoned which is a continuation of PCT/GB01/04349, filed Sep. 28, 2001, which claims priority of GB 0025337.7, filed Oct. 16, 2000.

FIELD OF THE INVENTION

This invention relates to a toy or novelty item involving an element of surprise.

BACKGROUND

A known jack-in-the-box toy comprises a box containing a figure arranged to jump out when the lid of the box is opened. The figure is attached to a spring, which forces the figure against the lid. In another known toy, a fabric-covered spring simulating a snake ejects itself from a rigid container on removing the lid.

In these known toys, the manufacture of the sprung figure is labor-intensive.

Known jack-in-the-box type toys are characterized by rapid deployment under the action of springs. There may be a plurality of ejecting or extending parts, but these operate substantially simultaneously.

SUMMARY OF THE INVENTION

This invention relates to a toy including an openable container, and a non-porous, molded, hollow, elastic three-dimensional representative object arranged to be contained in a compressed condition within the container such that on opening the container the object springs out by assuming its uncompressed shape and size.

In another aspect, the invention relates to a toy including an openable container, and a three-dimensional representative object arranged to be contained within the container such that on opening the container the object springs out, the container being arranged for attachment to another container, wherein opening of the container causes the adjacently fitted other container to open.

Yet another aspect of the invention relates to a toy including an openable container, and a plurality of representative objects concealed within the container such than on opening the container, the objects spring out in a predetermined order.

BRIEF DESCRIPTION OF THE DRAWINGS

The invention will now be described in more detail, by way of example only, with reference to the accompanying drawings, in which.

DETAILED DESCRIPTION OF THE PREFERRED EMBODIMENTS

Figure 1:
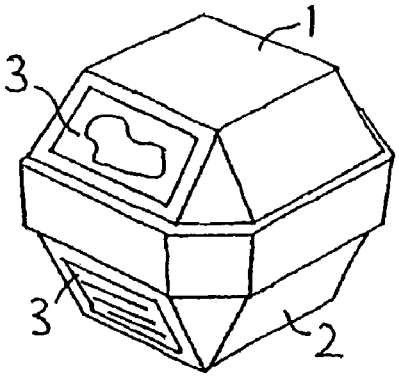
FIG. 1 is a perspective view of a container according to an embodiment of the invention.

One aspect of the invention provides a toy or novelty item comprising an openable container, and a non-porous, molded, hollow, elastic, three-dimensional representative object arranged to be contained in a compressed and distorted condition within the container such that on opening the container the object springs out under its inherent elasticity by assuming its uncompressed shape and size.

The representative object may comprise a human, animal, cartoon or fantasy figure or a vehicle or any object such as an item of food, furniture or clothing, which children may wish to collect. The representative object is conveniently injection molded, preferably in one piece, from rubber or an elastomeric material such as a styrene-butadiene-styrene copolymer or another of the copolymers sold under the trademark "Kraton".

Preferably, the container comprises a lid which is released to open the container. The container may comprise a capsule to which the lid is attached with an interference fit. Alternatively, a releasable catch may be provided for securing the lid to the container. A spring may be provided for biasing the lid into an open position. The container may comprise a parallelepiped box arranged to be demounted on releasing the lid.

The container may itself represent an object in the closed state, such as, but not limited to, a packing case, purse, bag or vehicle.

The representative object can be permanently or temporarily attached to the inside of the container. If the object is not attached or is detachable from the container, at least a portion of the container may be capable of forming a plinth on which the object can be stood.

The object may be decorated, for example, with paint or varnish. The container may be decorated on its outside and/or its inside, for example, by applying stickers or paint.

According to another embodiment of the invention, the container is capable of being attached to an identically shaped container. Such containers can be collected and any number of them can be fitted together in a series. Preferably, opening of one of the containers causes an adjacently fitted container, which may be identical to the first container or be a different collectable container, to open as well. Thus, a series of containers will open in sequence. This embodiment is not limited to compressible elastic representative objects.

Whilst the representative object is usually arranged to spring out generally vertically from the container, it may alternatively be arranged to spring out generally laterally. A plurality of elastic representative objects may be contained within the container. Additionally, one or more relatively rigid representative objects may be contained within the container, formed integrally with a base, wall or lid of the container and/or arranged to spring out when the container is opened, for example, by means of a hinged connection to a wall of the container.

Another aspect of the invention provides a toy or novelty item comprising an openable container, and a plurality of representative objects concealed within the container such that on opening the container the objects spring out in a predetermined order.

Preferably, at least one of the representative objects comprises a representative surface (for example, a floor or wall of a building) on an inside of a flap forming a portion of the container. Further springing representative objects may include figures, vehicles, items of furniture and other pieces of toy equipment.

In a preferred embodiment, on opening the container, for example, by releasing a catch or the like, at least one first representative object springs out quickly and at least one second representative springs out slowly so that it is finally deployed some time (e.g. a few seconds) after the first representative object is deployed. Slow springing may be achieved by using dampened springs in a manner similar to the "soft eject" mechanisms used in known audio tape recorders.

Further parts of the toy can be arranged to fold out under the action of gravity or under a user's control, for example, by pressing a button.

This aspect of the invention can with advantage be combined with the features mentioned above, such as the compressible, preferably hollow, elastic representative objects, which may be detachable, the mutually connectable containers and the containers which represent objects when in the closed condition.

Turning now to the drawings, FIG. 1 shows a container in the form of a capsule, comprising a lid 1 attached to a base 2 with an interference fit. The capsule is molded from relatively rigid plastics material and can be opaque, clear or tinted. The shape of the capsule allows labels 3 to be affixed.

Figure 2:
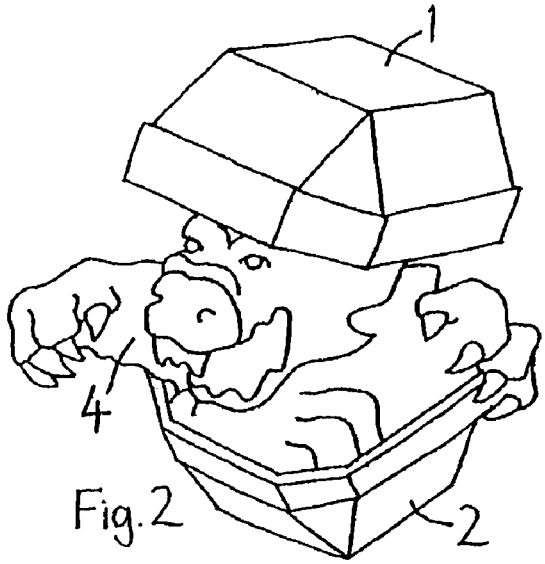
FIG. 2 shows the container of FIG. 1 with an object emerging therefrom.
Figure 3:
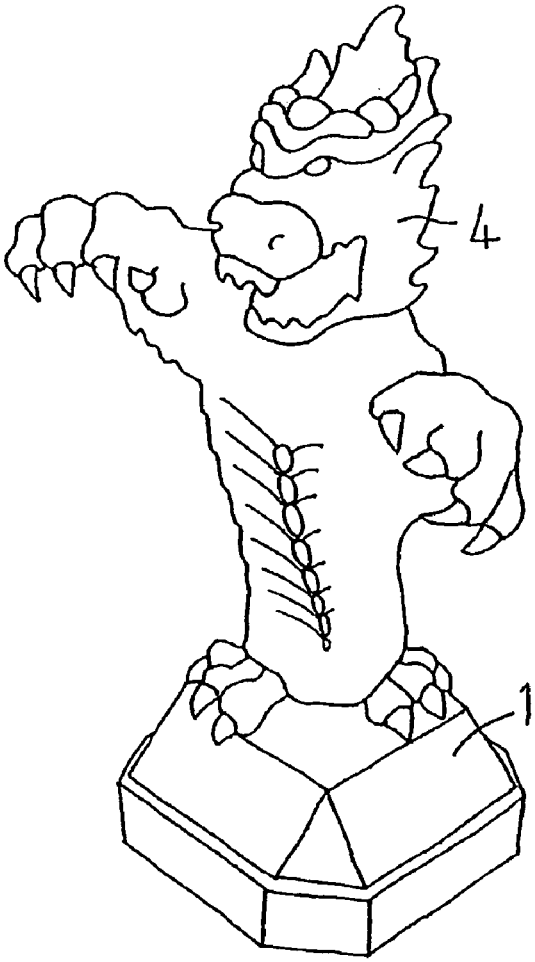
FIG. 3 shows the object of FIG. 2 mounted on a plinth formed from the lid of the container.
Figure 4:
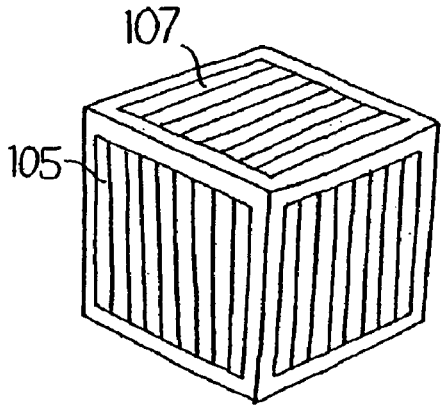
FIG. 4 shows a container according to a second embodiment.

The capsule contains a monster-like figure 4, shown in FIGS. 2 and 3, which has been compressed by hand to fit inside the capsule. The figure 4 is injection molded as a hollow body from an elastomeric material and painted.

By squeezing the base 2 of the capsule, the lid 1 is released and the figure 4 is free to pop up as shown in FIG. 2, assuming its original shape and size. Surprisingly, the figure 4 has been placed in a smaller space than its volume should allow, due to its elasticity and its hollow nature.

FIG. 3 shows how the lid 1 can be fitted over the upturned base to form a plinth on which the figure 4 is stood.

In an alternative embodiment, the capsule is a standard ovoid vending machine capsule.

Figure 5:
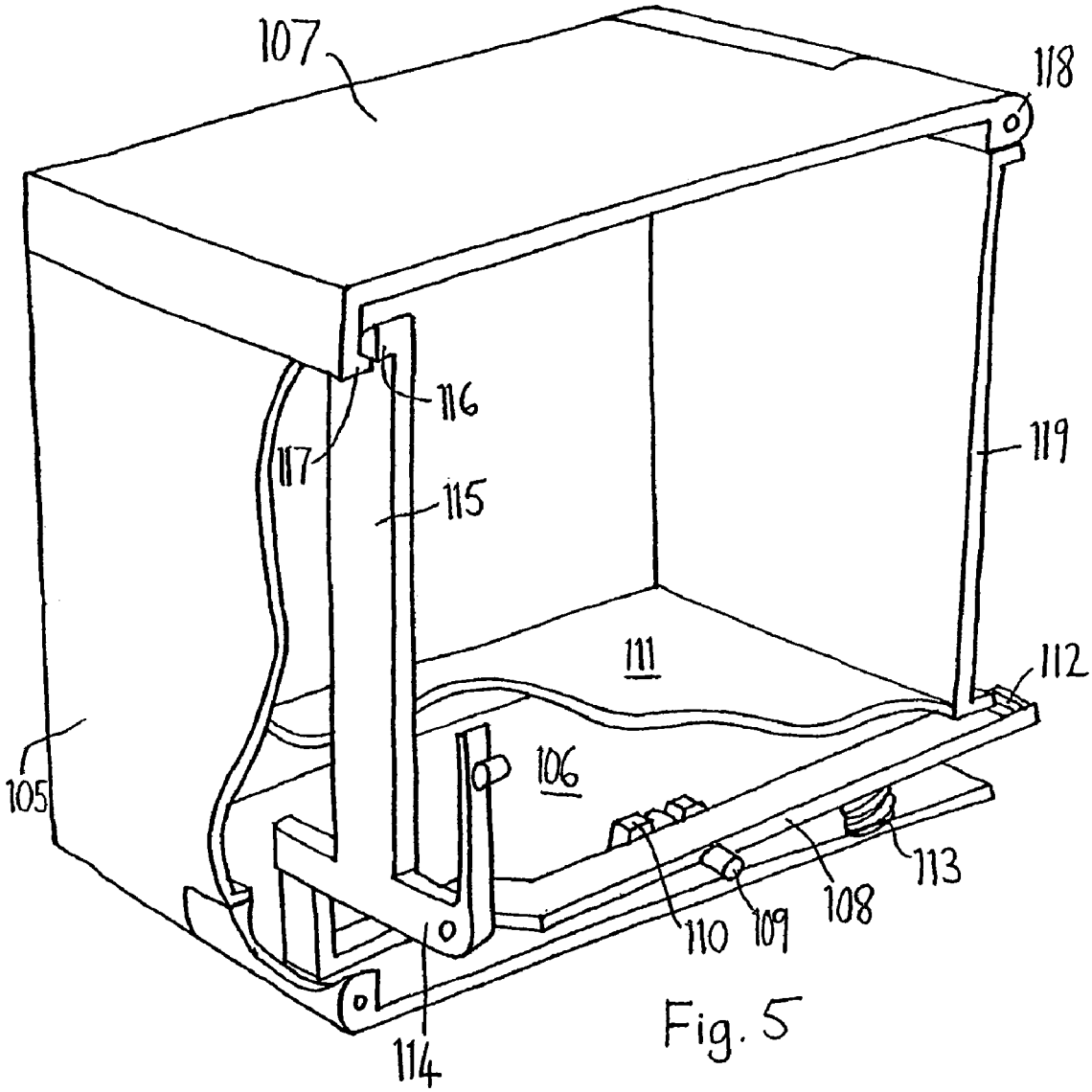
FIG. 5 is a cut-away side perspective view of the container of FIG. 4, not showing the representative object.

FIGS. 4 and 5 show an alternative container in the form of a cube-shaped box. Vertical walls 105 of the box are hinged to a base 106 but are not attached to each other. A lid 107 is hinged to the rear wall of the box and engages the other walls.

As shown in FIG. 5, a lever 108 is pivoted to the inside of the base 106 at its center, by means of pegs 109 which extend transversely from the lever and engage in seats 110 (only one of which is shown) on the base 106. The lever 108 extends below an internal floor 111 of the box and an end 112 of the lever protrudes from the rear of the box. An optional coil spring 113, fixed to the base 106, biases the lever 108 such that the end 112 is raised. The other end of the lever 108 is L-shaped and abuts one end of a pivotable cross bar 114, formed integrally with an initially vertical catch lever 115. A catch 116 at the top of the catch lever 115 engages a lip 117 depending from the front edge of the lid 107, and holds the lid closed. The hinge 118 connecting the lid 107 to the rear wall 119 is optionally fitted with a spring (not shown), biasing the lid upwardly.

Figure 6:
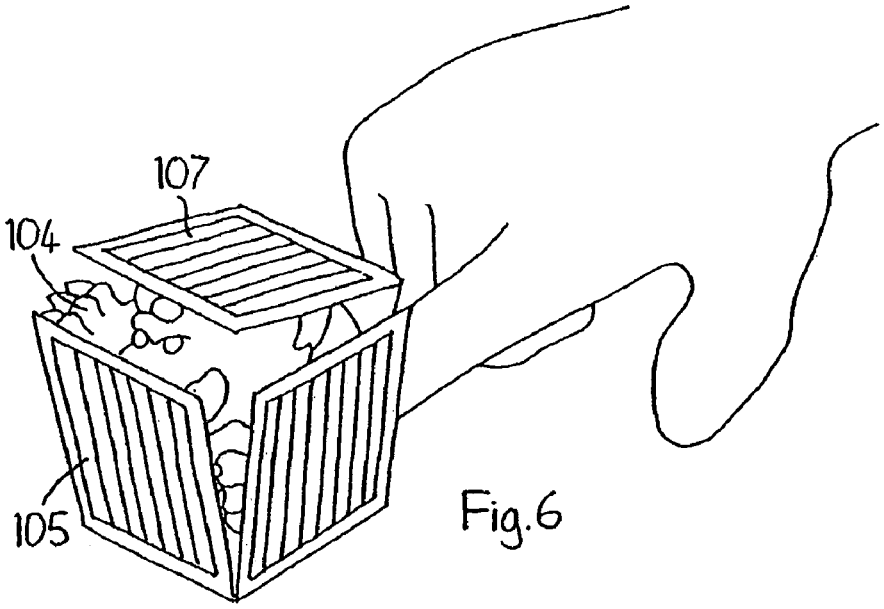
FIG. 6 shows the container of FIG. 4 in the process of being opened.
Figure 7:
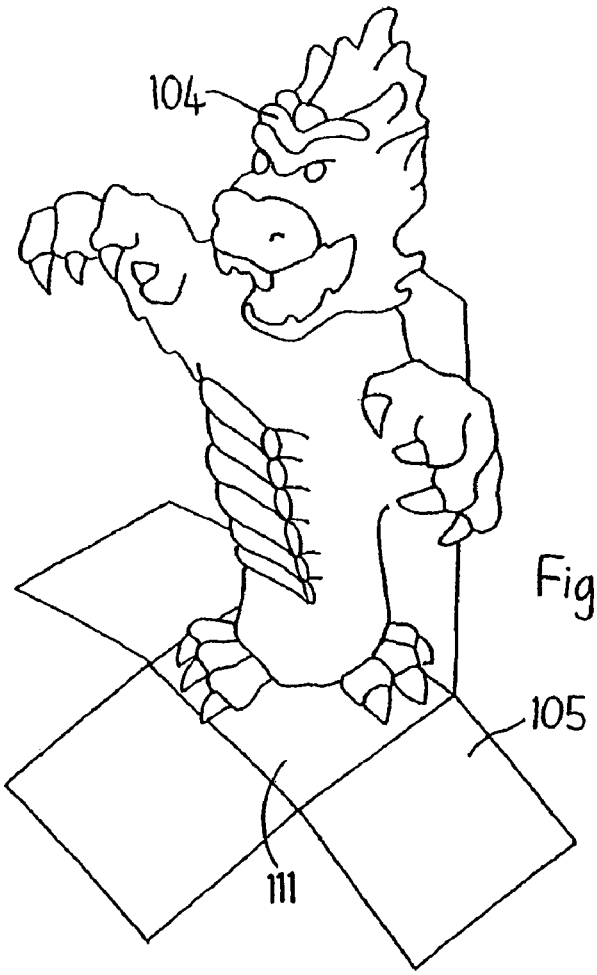
FIG. 7 shows the container of FIG. 4 in the opened position with the object extended.

To open the box, the protruding end 112 of the lever 108 is depressed, as shown in FIG. 6, against the action of the spring 113 or by pressure exerted by the FIG. 104. The other end of the lever moves upwardly, causing the cross bar 114 and the catch lever 115 to pivot. This releases the catch 116 from the lip 117 and the lid 107 opens under the action of the spring at the rear hinge 118. The walls 105 pivot downwardly and the FIG. 104 is extended as shown in FIG. 7.

Figure 8:
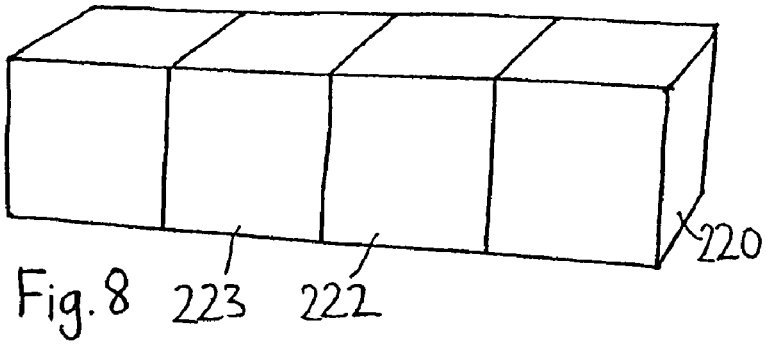
FIG. 8 shows containers according to a third embodiment.

FIG. 8 shows four boxes according to a third embodiment of the invention which have been clipped together using interengageable features on each of the boxes. The interengageable features may, for example, comprise pegs and slots which engage with slots and pegs respectively on an adjacent box.

Figure 9:
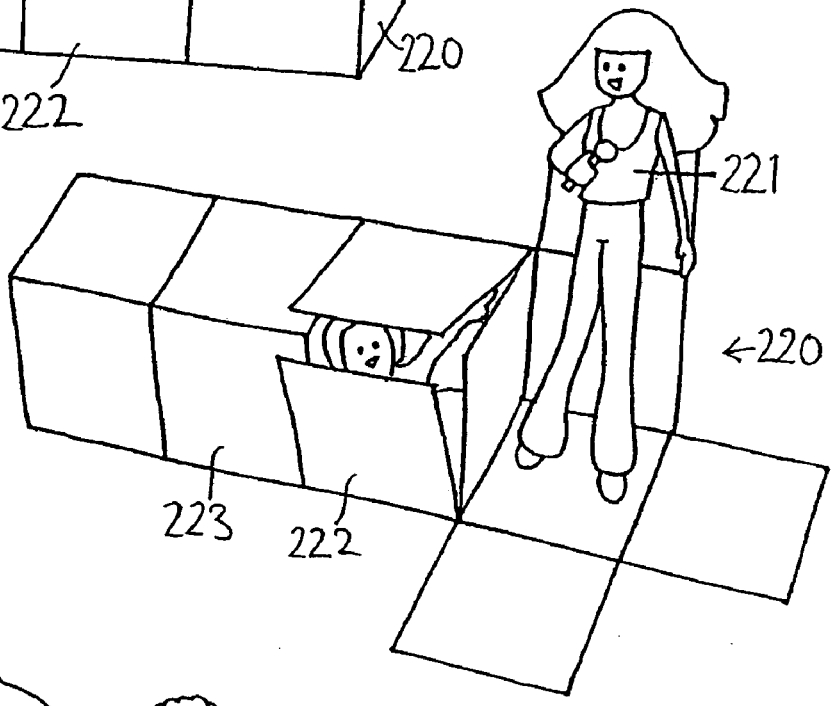
FIG. 9 shows the containers of FIG. 8 in the process of being opened.

As shown in FIG. 9, if one of the boxes 220 is opened, so that the contained FIG. 221 (in this case a pop singer) is extended, the adjacent box 222 is caused to open by the interaction of mechanical components of the boxes. This in turn causes the third box 223 to open, until all of the boxes have opened in sequence, and all of the figures are extended, as shown in FIG. 10.

Figure 10:
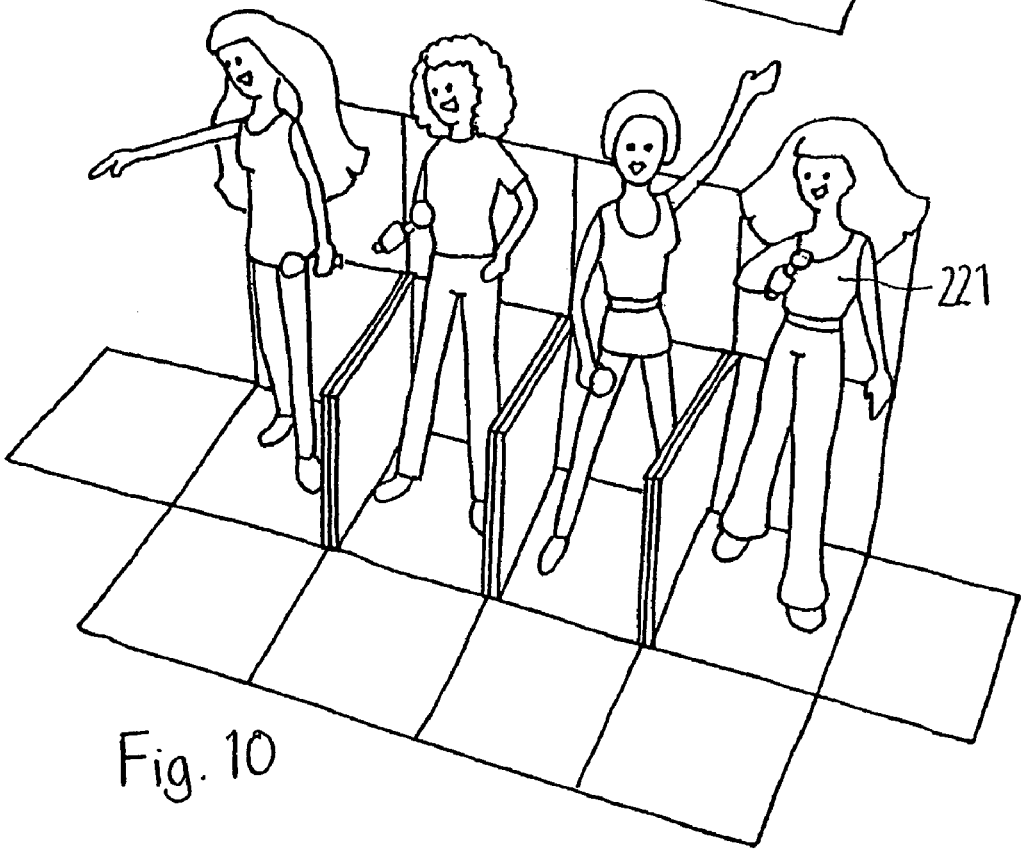
FIG. 10 shows the containers of FIG. 8 in the opened position with their objects extended.
Figure 11:
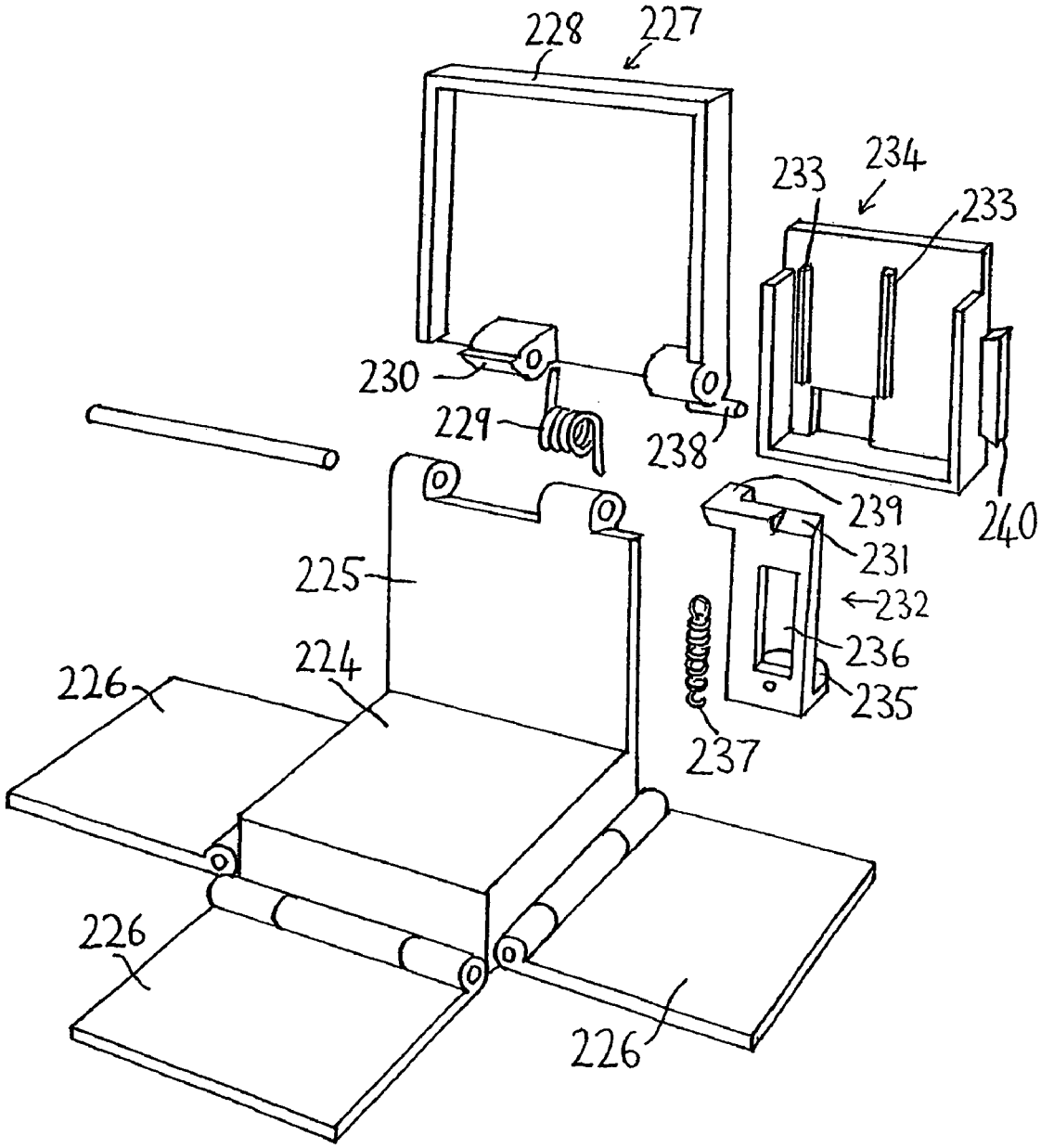
FIG. 11 is an exploded view of a possible mechanism for the toy shown in FIGS. 8 to 10.

FIG. 11 is an exploded view of one of the boxes shown in FIGS. 8 to 10, omitting the figure. The box comprises a raised base 224 formed integrally with a back wall 225, and side flaps 226 hinged to the base 224. A lid 227, which is hinged to the top of the back wall 225, has a peripheral skirt 228 for retaining the flaps 226 in a vertical position when the lid 227 is closed. The lid is biased towards the open position by a lid spring 229 but held closed by a catch 230, which engages a tongue 231 on a latch slide 232. This latch slide is arranged to slide up and down between guides 233 on a backplate 234 arranged parallel to, and fitting over, the back wall 225. An operating tab 235 of the latch slide 232 extends through a slot 236 in the backplate 234. The latch slide is biased towards its topmost position by means of a latch slide spring 237.

A peg 238 extends from the lid 227 at one corner adjacent the hinge. A striker plate 239 on the latch slide 232 extends from the backplate 234 at the other rear corner of the lid.

The backplate 234 has a dovetail connecter 240 on one side and a slot (not shown) of corresponding size on the other side. The boxes are connected together by inserting the dovetail connector of one box into the slot of another box.

By depressing operating tab 235 of one box and moving latch slide 232 downwards against the force of latch slide spring 237, tongue 231 disengages from catch 230 and lid 227 is raised about its hinge by lid spring 229. Skirt 228 no longer holds flaps 226, and any of the flaps which do not abut adjacent boxes fall open. At the same time peg 238 of lid 227 hits the striker plate of the adjacent box, if one is attached, causing its latch slide to move downwardly and opening the box. In this manner, a series of connected boxes is opened with a pleasing "domino effect".

Figure 12:
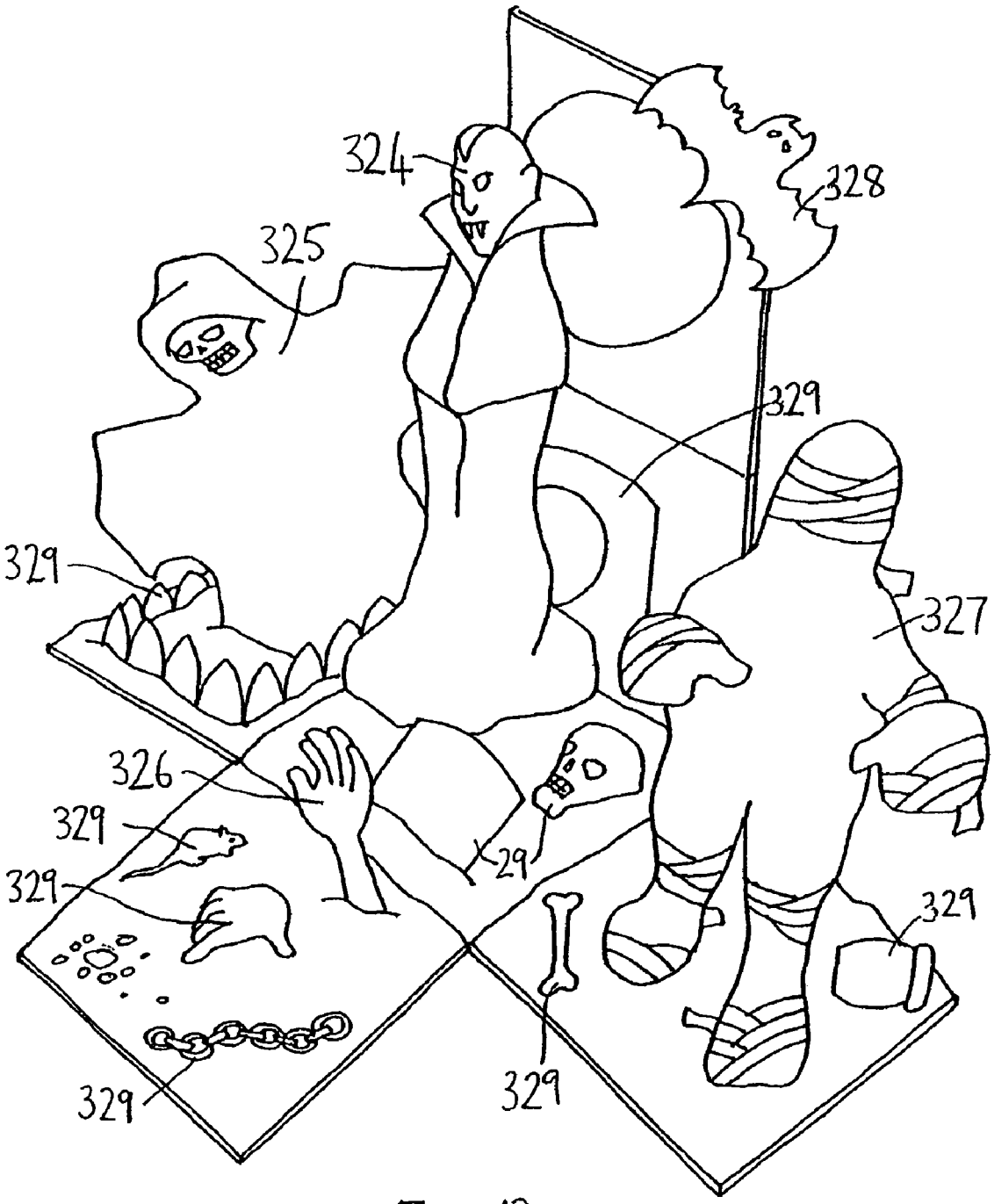
FIG. 12 shows a toy according to a fourth embodiment.

FIG. 12 shows an opened box according to a fourth embodiment, in which five elastic representative objects are extended, namely a vampire 324 attached to the base of the box, a ghost 325 attached to a first folded down wall, a hand 326 attached to a second folded down wall, a mummy 327 attached to a third folded down wall and a bat 328 attached to the raised lid. In addition to the elastic representative objects 325, 326, 327, 328, a number of rigid representative objects 329 are molded integrally with the base, walls and lid.

The representative object(s) in this aspect of the invention could be any kind of human, animal or imaginary figure or a plant or vehicle etc, or components (such as furniture) of a play set representing the inside of a house, kitchen or other room, garden etc.

Figure 13:
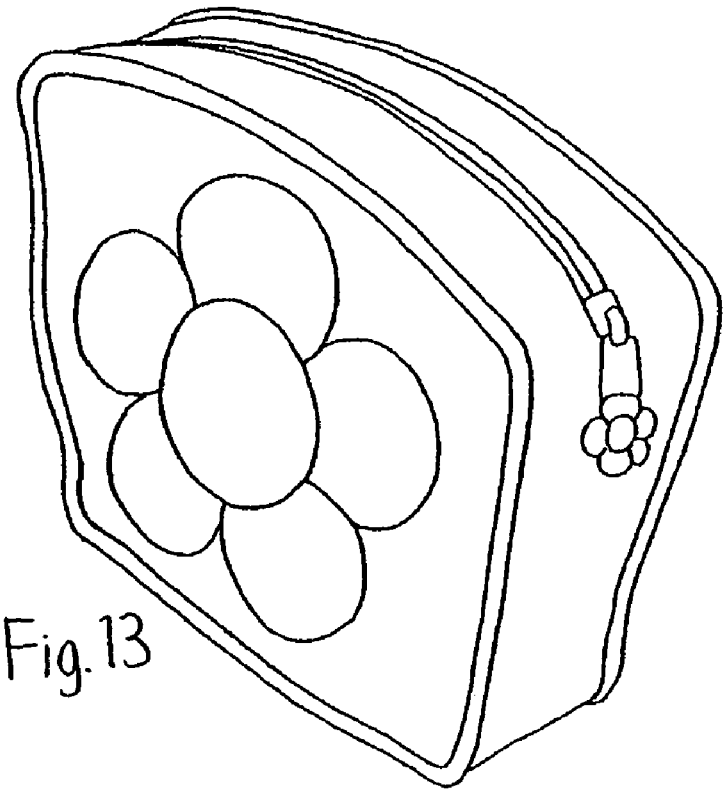
FIGS. 13 and 14 show, in the closed and opened conditions respectively, a toy according to an embodiment of the other aspect of the invention.
Figure 14:
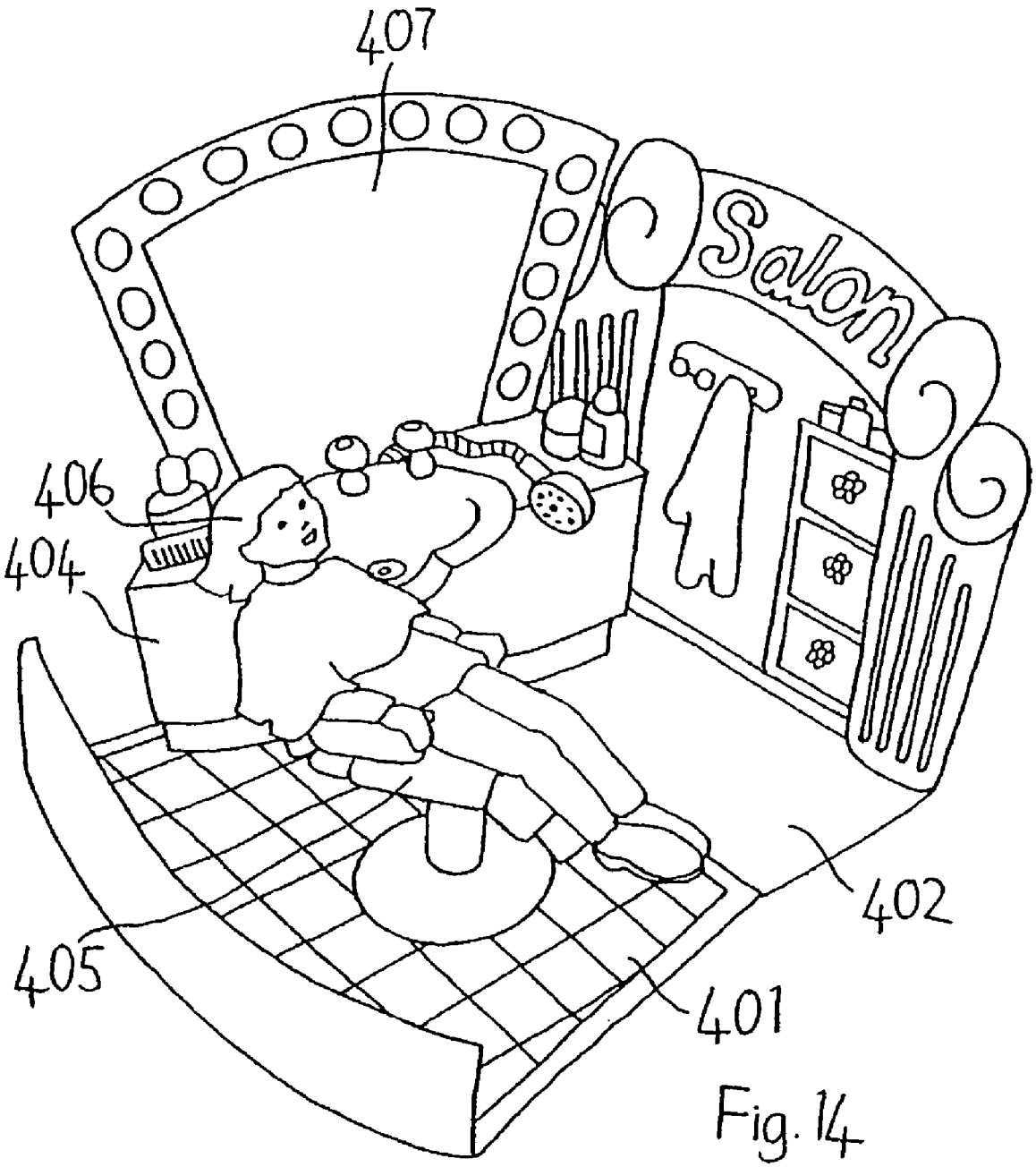

FIG. 13 shows a closed container according to the other aspect of the invention, in the form of a zip-up purse. FIG. 14 shows the container opened to form a toy hairdressing salon. Concealed springs, and/or any elastomeric representative objects in the toy, cause an initial rapid opening, with inside surfaces of the container then representing different floor portions 401, 402 and wall 403 of the salon. A counter 404 and a chair 405 then slowly pivot out to the positions shown in FIG. 13 under the action of concealed dampened springs. A figure 406 in the chair 405 may be elastomeric or rigid and may be supplied as a separate item and placed in position subsequently. A mirror 407 can be made to "pop up" by a sprung pushbutton-operated mechanism (not shown) and the chair 405 can be swiveled to different positions.

Figure 15:
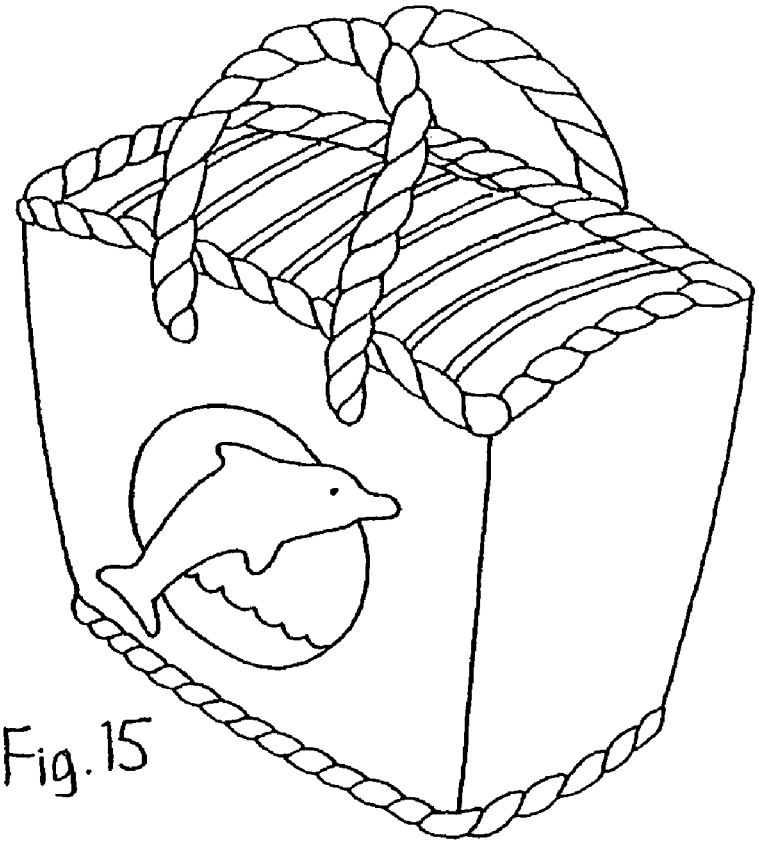
FIGS. 15 and 16 show in the closed and opened conditions respectively a toy according to a further embodiment of the other aspect of the invention.
Figure 16:
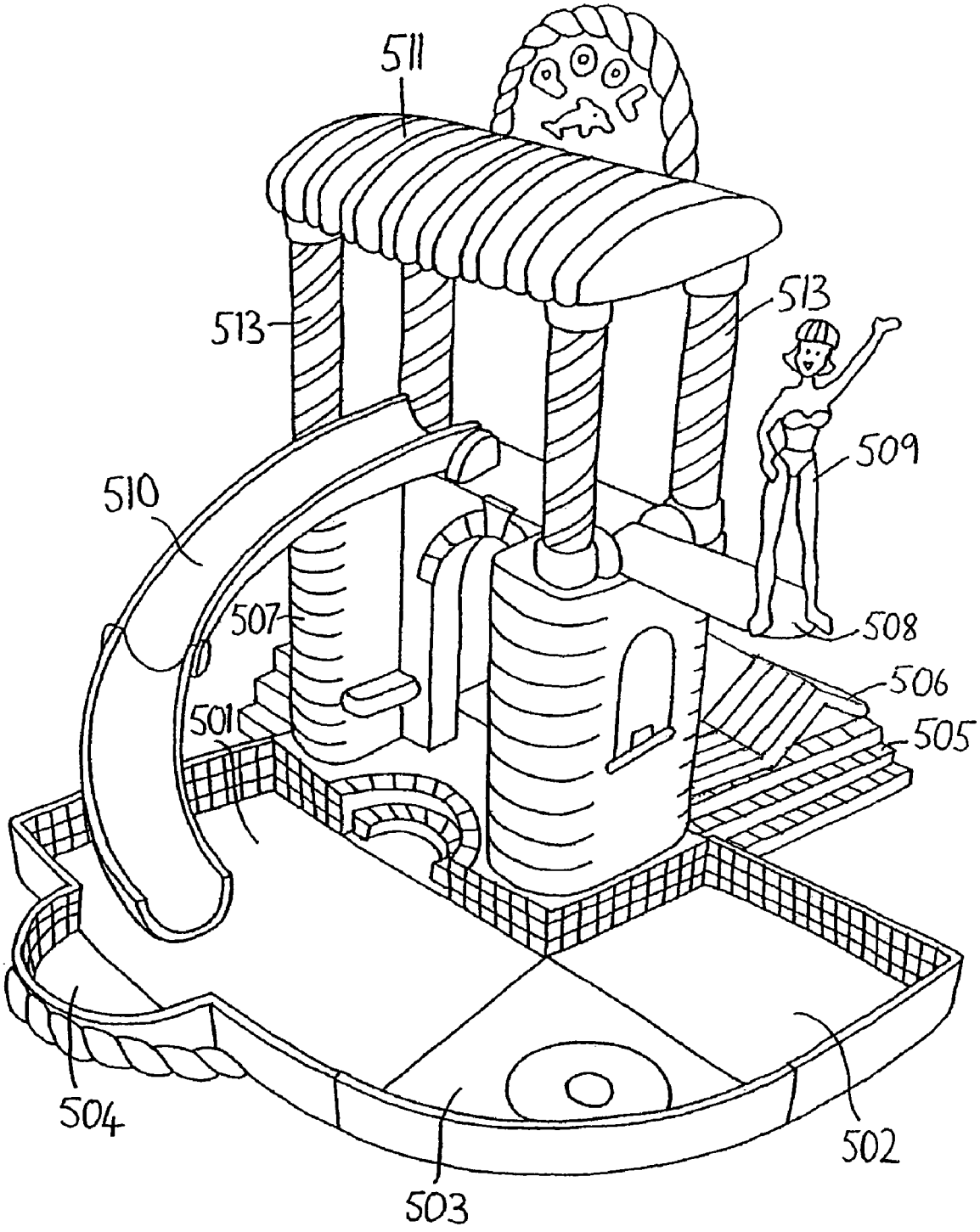

FIG. 15 shows an alternative closed container in the form of a bag or hamper, which opens to form a swimming pool toy as shown in FIG. 16. Sections 501, 502 of the container are caused to form sections of a pool, and further sections 503, 504 which are concealed when the container is closed fold out to complete the pool. Another side 505 of the container represents a poolside portion when opened, featuring a sun lounger 506 which can be made to fold by a pushbutton mechanism (not shown). A central substantially rigid building part 507 has a folding springboard 508 with an optionally detachable figure 509 and a two part folding slide 510. A canopy 511 with a pop-up sign 512 is supported on pillars 513 which slowly slide out of the building part 507 to raise the canopy after the container is opened.

In addition to the springing out of the representative object(s), opening of containers according to the invention could trigger one or more other events, such as music or other sounds, lights, or other motion (for example rotation) of the container or its contents.

What is claimed is:

1. A toy comprising an openable container having a multiplicity of flaps that form a hollow chamber and a plurality of representative objects concealed within the chamber such that on opening the container, the objects spring out in a predetermined order such that at least one first representative object springs out at a speed slower than at least one second representative object whereby the first representative object is caused to spring out with a dampened spring and wherein at least one of the representative objects comprises a representative surface on an inside of one of the flaps forming a portion of the container.

2. The toy according to claim 1, comprising further parts of the toy arranged to fold out under action of gravity or under a user's control.

3. The toy according to claim 1, wherein a plurality of elastic representative objects is contained within the container.

4. The toy according to claim 3, wherein at least one relatively rigid representative object is arranged to spring out of the container when the container is opened.

5. The toy according to claim 1, wherein the objects or at least one of the objects is decorated.

6. The toy according to claim 1, wherein the container is decorated on its outside and its inside.

7. The toy according to claim 1, wherein the first and second representative objects are arranged to spring out generally vertically from the container.

8. The toy according to claim 1, wherein the first and second representative objects are arranged to spring out generally laterally from the container.

9. The toy according to claim 1, wherein opening of the container triggers another action in addition to the springing out of the representative objects.

10. The toy according to claim 1, wherein the container is attachable to an identically shaped container.

11. The toy according to claim 1, wherein the container itself represents an object in a closed state.

12. The toy according to claim 1, wherein the container is decorated on its outside or its inside.

13. A toy comprising an openable container having a multiplicity of flaps that form a hollow chamber and a plurality of representative objects concealed within the chamber such that on opening the container, the objects spring out in a predetermined order such that at least one first representative object springs out at a speed faster than at least one second representative object that is caused to spring out with a dampened spring and wherein at least one of the representative objects comprises a representative surface on an inside of one of the flaps forming a portion of the container.

14. The toy according to claim 13, comprising further parts of the toy arranged to fold out under action of gravity or under a user's control.

15. The toy according to claim 13, wherein a plurality of elastic representative objects is contained within the container.

16. The toy according to claim 15, wherein at least one relatively rigid representative object is arranged to spring out of the container when the container is opened.

17. The toy according to claim 13, wherein the objects or at least one of the objects is decorated.

18. The toy according to claim 13, wherein the container is decorated on its outside and its inside.

19. The toy according to claim 13, wherein the first and second representative objects are arranged to spring out generally vertically from the container.

20. The toy according to claim 13, wherein the first and second representative objects are arranged to spring out generally laterally from the container.

21. The toy according to claim 13, wherein opening to container triggers another action in addition to the springing out of the representative objects.

22. The toy according to claim 13, wherein the container is attachable to an identically shaped container.

23. The toy according to claim 13, wherein the container itself represents an object in a closed state.

24. The toy according to claim 13, wherein the container is decorated on its outer or its inside.

* * * * *